US010822165B2

(12) United States Patent
Wang et al.

(10) Patent No.: US 10,822,165 B2
(45) **Date of Patent: *Nov. 3, 2020**

(54) WATERPROOF INDUCTION ACTUATED CONTAINER

(71) Applicants: Xin Wang, Fuzhou (CN); Jiangqun Chen, Fuzhou (CN)

(72) Inventors: Xin Wang, Fuzhou (CN); Jiangqun Chen, Fuzhou (CN)

(73) Assignee: Nine Stars Group (U.S.A.) Inc., Pomona, CA (US)

( * ) Notice: Subject to any disclaimer, the term of this patent is extended or adjusted under 35 U.S.C. 154(b) by 180 days.

This patent is subject to a terminal disclaimer.

(21) Appl. No.: 15/884,342

(22) Filed: Jan. 30, 2018

(65) Prior Publication Data

US 2018/0170669 A1 Jun. 21, 2018

Related U.S. Application Data

(63) Continuation of application No. 15/271,211, filed on Sep. 20, 2016, now Pat. No. 10,077,154.

(51) Int. Cl.
*B65F 1/16* (2006.01)

(52) U.S. Cl.
CPC ..... *B65F 1/1638* (2013.01); *B65F 1/1646* (2013.01); *B65F 2001/1684* (2013.01); *B65F 2210/168* (2013.01)

(58) Field of Classification Search
CPC ..... A47G 19/32; A47G 29/00; H02P 9/18; G05B 2219/37604
See application file for complete search history.

(56) References Cited

U.S. PATENT DOCUMENTS 7,338,635 B2 * 3/2008 Miyake ..... E05D 11/082 422/243
2004/0069325 A1 * 4/2004 Cerruti ..... A47L 15/4409 134/25.2

* cited by examiner

*Primary Examiner* — Bickey Dhakal
(74) *Attorney, Agent, or Firm* — Raymond Y. Chan; David and Raymond Patent Firm

(57) ABSTRACT

A waterproof induction container includes a container body and an induction actuated container cover. The container body includes a storage cavity and a container opening. The induction actuated container cover includes a control housing, a cover panel, and an automatic driving arrangement. The control housing has a side concealed compartment and a cover opening. The cover panel is pivotally mounted to the control housing to pivotally move between a closed position and an opened position. The automatic driving arrangement is concealed in the side concealed compartment of the control housing in a waterproof manner to prevent any contamination of the automatic driving arrangement by moisture, corrosive gas, and trash residuals.

24 Claims, 8 Drawing Sheets

WATERPROOF INDUCTION ACTUATED CONTAINER

CROSS REFERENCE OF RELATED APPLICATION

This is a Continuation application that claims the benefit of priority under 35 U.S.C. § 120 to a non-provisional application, application Ser. No. 15/271,211, filed Sep. 20, 2016. The afore-mentioned patent application is hereby incorporated by reference in its entirety.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a container, and more particularly to a waterproof induction container, wherein the electrical and mechanical components are sealed in a concealed compartment of the container to prevent any contamination of the electrical and mechanical components by moisture, corrosive gas, and/or trash residuals.

Description of Related Arts'

A conventional container for storing predetermined objects, such as a trash container, usually comprises a container body having a storage cavity formed therein, and an opening communicated with the storage cavity, and a cover panel movably mounted on top of the housing for selectively opening and enclosing the storage cavity for allowing the user to dispose predetermined objects into the container body. When the container is not in use, the storage cavity is substantially enclosed for physically separating the objects disposed in the storage cavity from an exterior of the container.

In recent years, electrically-operated containers or induction containers have been developed in which the cover panel is largely driven by electrical and mechanical components so as to achieve automatic opening or closing of that cover panel via a motor. For most of these induction containers, such as induction trash cans, a sensor is formed on the housing and is utilized for detecting a target movement, such as a movement of the person throwing trash, in a detection range, so that when that person stands in that detection range, the sensor will send a signal to the relevant electrical components so as to automatically lift up the cover panel, and when the user has left the detection range, the sensor will send a corresponding signal to those electrical components for automatically lowering down the cover panel so as to close the container.

However, the conventional induction container has several drawbacks. The convention induction container does not include any water resistance feature to protect the electrical and mechanical components. For example, when the trash is disposed in the storage cavity of the container body, fluid residuals in the trash may accidently spilled to the container body to damage the electrical and/or mechanical components. In addition, moisture and/or corrosive gas will be released from the trash, such that a circuit board and/or mechanical components of the induction container will be eroded to shorten the service lifespan of the induction container.

In addition, the actuation of the cover panel is driven to open and close by the motor via a transmission shaft. In particular, one end of the transmission shaft is connected to the cover panel, and an opposed end of the transmission shaft is connected to the motor via a gear unit. Through the structural configuration of the transmission shaft with the gear unit, the electrical and mechanical components cannot be concealed in a storage compartment of the housing. In addition, the transmission shaft is exposed, such that moisture, corrosive gas, and/or trash residuals will inevitably contaminate the transmission shaft, the gear unit, and even the storage compartment.

Accordingly, a power supply unit is provided at the housing, wherein the power supply unit has a battery compartment formed at the bottom side of the housing and a battery cover detachably coupled at the bottom side of the housing to cover the battery compartment. Therefore, the battery cover may accidentally fall into the storage cavity of the container body. The moisture, corrosive gas, and/or trash residuals will also inevitably contaminate the battery in the battery compartment and will erode the power supply unit as well. Once the power supply unit is malfunctioned, the cover panel cannot be operated as well. It is also inconvenient for the user to replace the battery in the battery compartment because the housing must be detached from the container body for battery replacement.

SUMMARY OF THE PRESENT INVENTION

The invention is advantageous in that it provides a waterproof induction container, wherein different electrical and mechanical components of the container are concealed in the side concealed compartment in a waterproof manner to prevent any contamination of the electrical and mechanical components by moisture, corrosive gas, and/or trash residuals. Therefore, the electrical and mechanical components of the container will be protected within the side concealed compartment against such adverse environmental factor as excess humidity, so as to prolong a general life span of the present invention.

Another advantage of the invention is to a waterproof induction container, wherein the pivot shaft is directly driven by an actuation unit to move the cover panel between an opened position and a closed position.

Another advantage of the invention is to a waterproof induction container, wherein two end portions of the pivot shaft are extended into the side concealed compartments respectively and are operatively linked to the actuation unit and a resilient element, such that the rotational movement of the pivot shaft is balanced at the two ends portions thereof to ensure the smooth pivotal movement of the cover panel.

Another advantage of the invention is to a waterproof induction container, wherein the exposed portion of the pivot shaft between the two end portions thereof is received along a shaft sleeve of the cover panel to conceal the exposed portion of the pivot shaft so as to prevent the pivot shaft from exposing to the container opening of said container body.

Another advantage of the invention is to a waterproof induction container, wherein the gear transmission unit serves as a decelerating gear unit for controllably lifting up and dropping down the cover panel at a speed determined by gear ratios of the gear transmission unit so as to move the cover panel between the opened and closed positions in a hydraulic manner.

Another advantage of the invention is to provide a water induction container, wherein the servo motor, the transmission gear unit, and the pivot shaft are directly and operatively linked with each other so as to minimize energy lost through the energy transmission.

Another advantage of the invention is to a waterproof induction container, wherein the power supply unit is provided at the rear portion of the control housing, such that the user is able to access the power supply unit, such as replacing the battery, without detaching the control housing from the container body. In addition, since there is no access of the power supply unit from the storage cavity, the battery compartment is not communicated with the storage cavity to prevent any contamination of the battery compartment by moisture, corrosive gas, and/or trash residuals from the storage cavity.

Another object of the present invention is to provide a waterproof induction container, wherein the induction actuated container cover can be adapted to perform a wide variety of functions so as to allow widespread application of the present invention.

Another object of the present invention is to provide a waterproof induction container, which does not require to alter the original structural design of the induction container, so as to minimize the manufacturing cost of the induction container incorporating with the induction actuated container cover.

Another object of the present invention is to provide a waterproof induction container, wherein no expensive or complicated structure is required to employ in the present invention in order to achieve the above mentioned objects. Therefore, the present invention successfully provides an economic and efficient solution for providing a sterilized and clean configuration for the induction container to prevent any contamination of the electrical and mechanical components of the induction container.

Additional advantages and features of the invention will become apparent from the description which follows, and may be realized by means of the instrumentalities and combinations particular point out in the appended claims.

According to the present invention, the foregoing and other objects and advantages are attained by a waterproof induction container which comprises a container body and an induction actuated container cover. The container body has a storage cavity and a container opening communicating with the storage cavity. The induction actuated container cover comprises a control housing, a cover unit, and an automatic driving arrangement.

The control housing is detachably coupled at the container body at the container opening thereof, wherein the control housing has first and second side concealed compartments formed at a rear portion of the control housing, and a cover opening formed between the first and second side concealed compartments to communicate with the storage cavity of the container body.

The cover unit comprises a pivot shaft having first and second end portions extended into the first and second side concealed compartments respectively, and a cover panel pivotally mounted to the control housing via the pivot shaft to pivotally move between a closed position that the cover panel covers at the cover opening to enclose the storage cavity and an opened position that the cover panel exposes the cover opening for communicating with the storage cavity.

The automatic driving arrangement comprises a sensor unit mounted at the control housing for detecting a target movement of a user, and an actuation unit concealed in the first side concealed compartment of the control housing in a waterproof manner to operatively link with the sensor unit and to operatively coupled to the pivot shaft, wherein the actuation unit is actuated to move the cover panel via the pivot shaft between the opened and closed positions.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
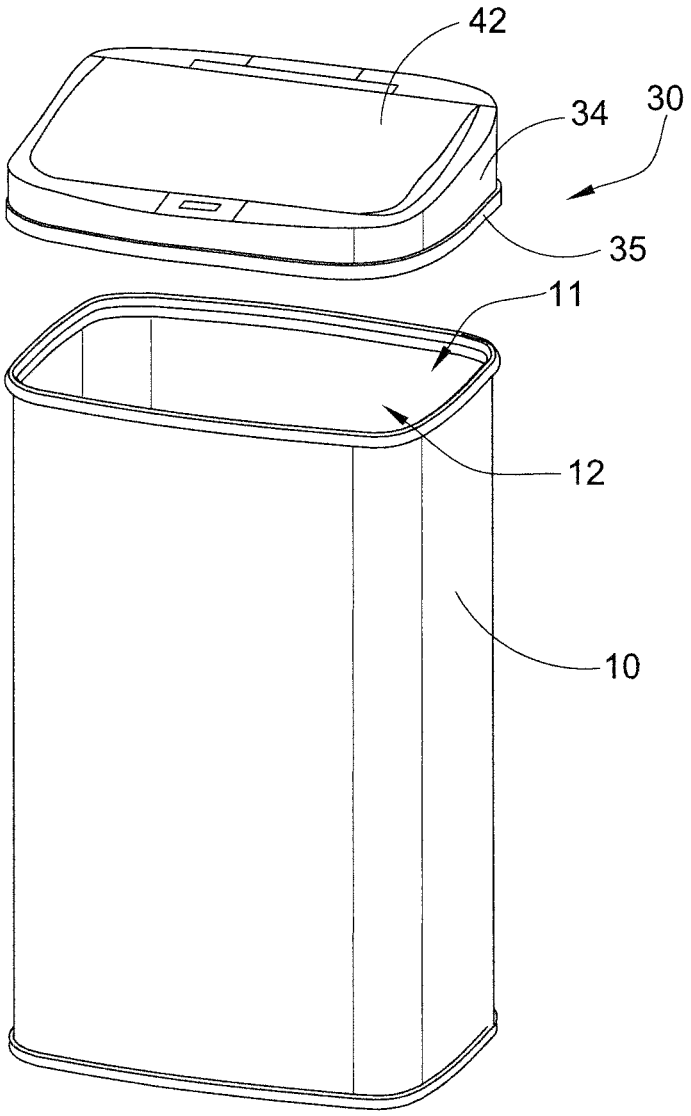
FIG. 1 is a perspective view of a waterproof induction container according to a preferred embodiment of the present invention.
Figure 2:
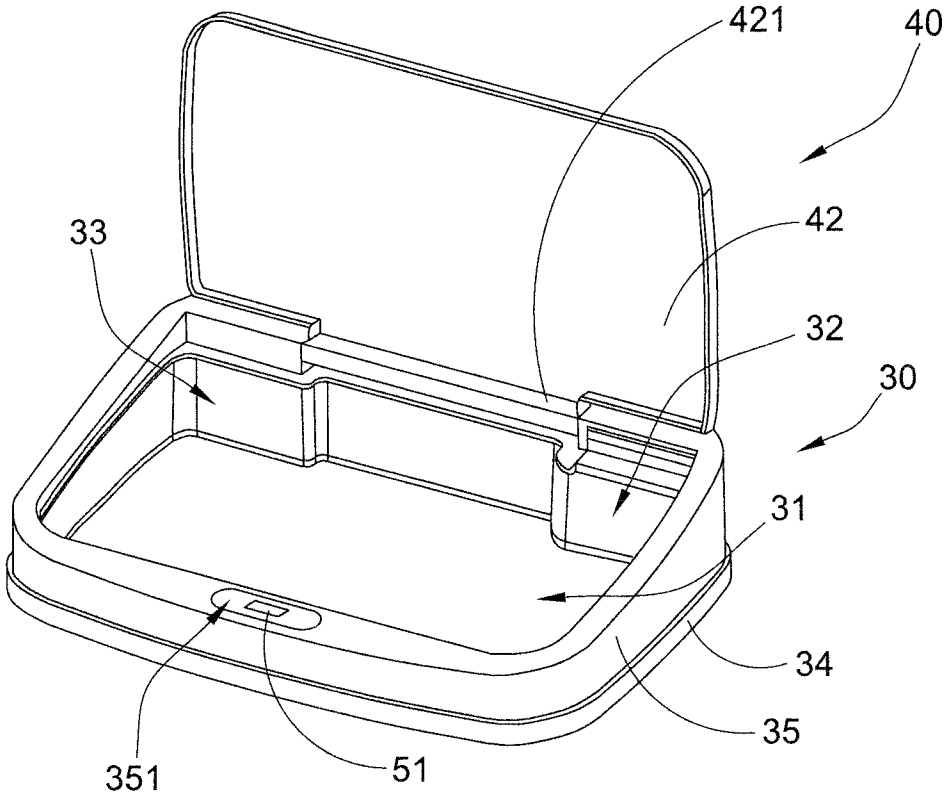
FIG. 2 is an exploded perspective view of the waterproof induction container according to the above preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 1 to FIG. 7 of the drawings, a waterproof induction container according to a preferred embodiment of the present invention is illustrated, wherein the waterproof induction container comprises a container body 10 and an induction actuated container cover.

The container body 10 has a storage cavity 11 and a container opening 12 formed at an upper portion of the container body 10, wherein the storage cavity 11 is utilized for storing predetermined objects, such as trash, disposed by a user of the present invention. Accordingly, the container opening 12 forms a top opening of the container body 10.

The induction actuated container cover comprises a control housing 30, a cover unit 40, and an automatic driving arrangement 50. The control housing 30, having a cover opening 31, is adapted for mounting at the container body 10 at the container opening thereof 11 to communicate the cover opening 31 with the storage cavity 11 of the container body 10. The control housing 30 further has first and second side concealed compartments 32, 33 formed at a rear portion of the control housing 30, wherein the cover opening 31 is formed between the first and second side concealed compartments 32, 33 to communicate with the storage cavity 11 of the container body 10. In one embodiment, the first and second side concealed compartments 32, 33 are left and right concealed compartments of the control housing 30.

The cover unit 40 comprises a pivot shaft 41 having first and second end portions 411, 412 extended into the first and second side concealed compartments 32, 33 respectively, and a cover panel 42 pivotally mounted to the control housing 30 via the pivot shaft 41 to pivotally move between a closed position that the cover panel 42 covers at the cover opening 31 to enclose the storage cavity 11 and an opened position that the cover panel 42 exposes the cover opening 31 for communicating with the storage cavity 11.

The automatic driving arrangement 50 comprises a sensor unit 51 mounted at the control housing 30 for detecting a target movement of a user, and an actuation unit 60 concealed in the first side concealed compartment 32 of the control housing 30 in a waterproof manner to operatively link with the sensor unit 51 and to operatively coupled to the pivot shaft 41, wherein the actuation unit 60 is actuated to move the cover panel 42 via the pivot shaft 41 between the opened and closed positions.

According to the preferred embodiment, the control housing 30 has a trapezoid cross section that a height of the front portion of the control housing 30 is shorter than that of the rear portion thereof to maximize a size of each of the first and second side concealed compartments 32, 33. Accordingly, a longitudinal width of the cover opening 31 between two sidewalls of the control housing 30 is larger than a transverse width of the cover opening 31 between the front wall and the rear wall of the control housing 30 to maximum an usable opening area of the cover opening 31 when the cover panel 42 is pivotally moved at the opened position.

In particular, the control housing 30 comprises a lower base frame 34 detachably coupled at the container opening 12 of the container body 10, and an upper casing 35 sealed and coupled at the lower base frame 34 to define the first and second side concealed compartments 32, 33 therebetween. Accordingly, the base frame 34, which has a annular shape, has a base platform 341 to support the automatic driving arrangement 50, wherein a sealing channel 342 is upwardly extended from a peripheral of the base platform 341 and a coupling channel is downwardly extended from the peripheral of the base platform 341 to detachably engage with an opening rim of the container opening 12 of the container body 10. The upper casing 35 is sealed and coupled on the base frame 34. In particular, a bottom edge of the upper casing 35 is sealed and coupled at the sealing channel 342 of the base frame 34. Preferably, a sealing element 343 is disposed along the sealing channel 342 of the base frame 34 and is provided to seal a connection between the bottom edge of the upper casing 35 and the sealing channel 342 of the base frame 34 to ensure the waterproof configuration of the first and second side concealed compartments 32, 33. It is worth mentioning that the upper casing 35 has a trapezoid cross section to maximize the size of each of the first and second side concealed compartments 32, 33.

Figure 4:
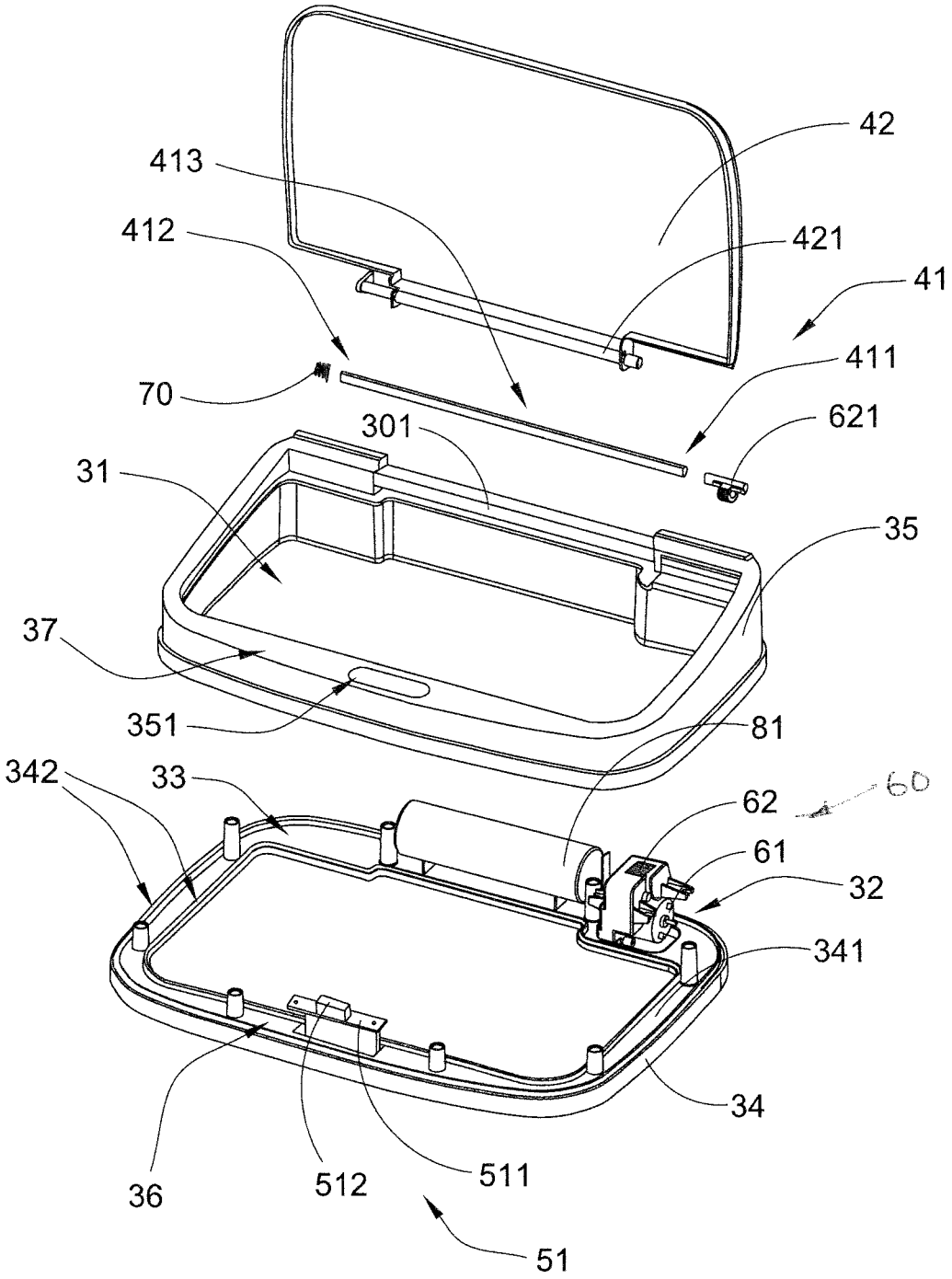
FIG. 4 is a perspective view of the induction actuated container cover of the waterproof induction container without the upper casing according to the above preferred embodiment of the present invention.

As shown in FIG. 4, the pivot shaft 41 is an elongated shaft extended between the first and second side concealed compartments 32, 33. In particular, the two end portions 411, 412 of the pivot shaft 41 are extended into and sealed in the first and second side concealed compartments 32, 33 respectively. The pivot shaft 41 further has an exposed portion 413 defined between the two end portions 411, 412, wherein the cover panel 42 is coupled at the exposed portion 413 of the pivot shaft 41.

Accordingly, the cover panel 42 has a folding edge coupled at the exposed portion 413 of the pivot shaft 41 and a free edge being pivotally on the control housing 30 to enclose the cover opening 31 thereof. The cover panel 42 comprises a shaft sleeve 421 formed along the folding edge thereof, wherein the exposed portion 413 of the pivot shaft 41 is received in the shaft sleeve 421 to conceal the exposed portion 413 of the pivot shaft 41 so as to prevent the pivot shaft 41 from exposing to the container opening 12 of the container body 10.

It is worth mentioning that the exposed portion 413 of the pivot shaft 41 has a non-circular cross section and the shaft sleeve 421 has a corresponding non-circular cross section to fit the exposed portion 413 of the pivot shaft 41, such that when the pivot shaft 41 is received along the shaft sleeve 421 and is driven to rotate, the cover panel 42 is pivotally moved between the opened and closed positions. As shown in FIG. 4, the control housing 30 further comprises a shaft housing 301 integrally extended between the first and second side concealed compartments 32, 33, wherein the shaft sleeve 421 is received in the shaft housing 301, such that the pivot shaft 41 is hidden within the shaft housing 301 to keep the pivot shaft 41 away from the container opening 12 of the container body 10.

According to the preferred embodiment, the sensor unit 51 comprises a sensor circuit board 511 and a sensor 512 operatively linked to the sensor circuit board 511, wherein the sensor circuit board 511 and the sensor 512 are concealed in the front concealed compartment 36. The sensor 512 is mounted at a front side of the control housing 30 for delivering a sensor signal from a front side of the control housing 30 to detect a user's movement in front of the container body 10. The sensor circuit board 511 is electrically connected to the actuation unit 60 in such a manner that when the sensing unit 2311 detects the user's movement in front of the container body 10, the sensor 512 will send a corresponding sensor signal to the actuation input 60 for actuating the cover panel 42 to move from the normal closed position to the opened position.

Figure 3:
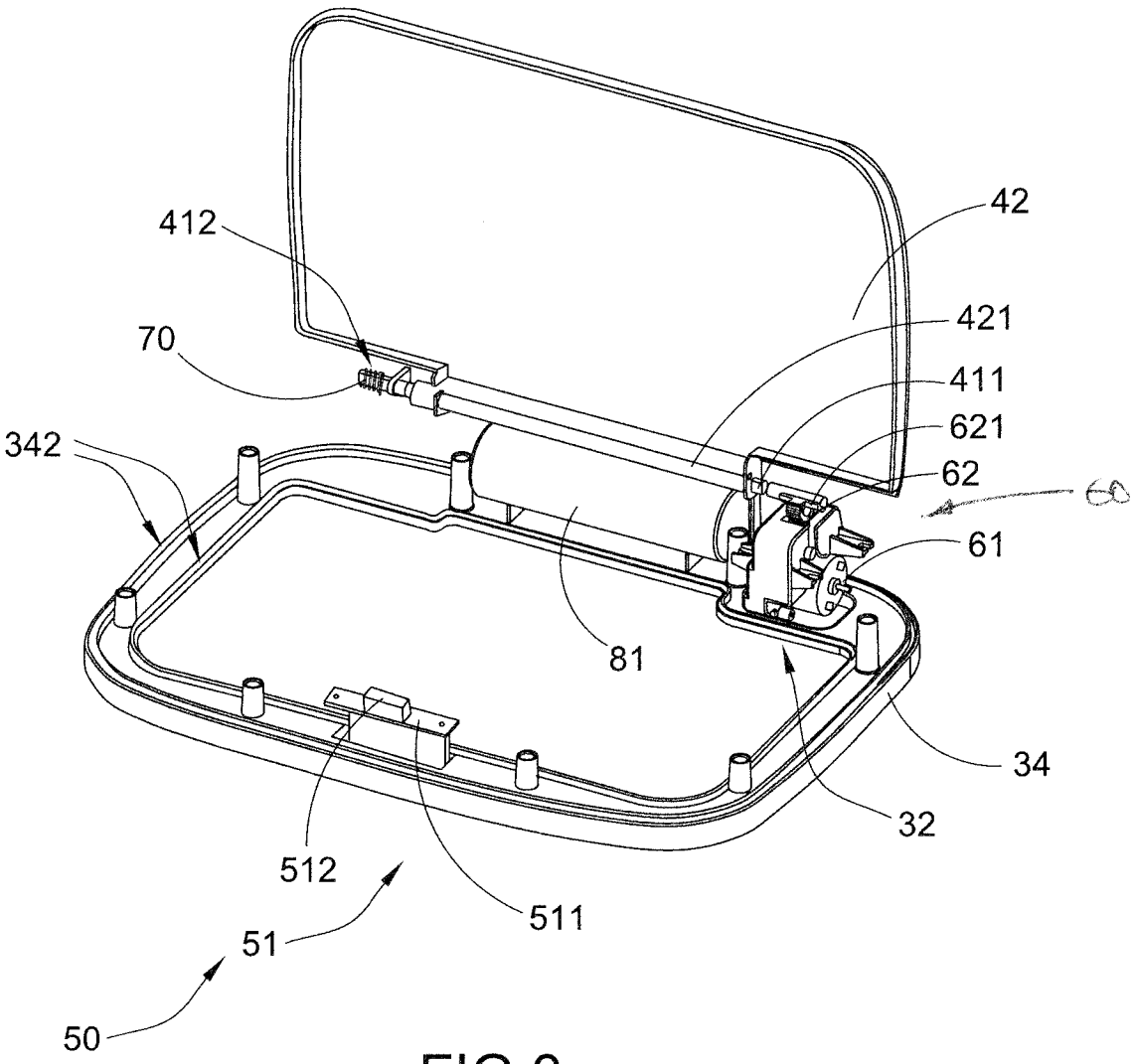
FIG. 3 is a perspective view of the induction actuated container cover of the waterproof induction container according to the above preferred embodiment of the present invention.

As shown in FIGS. 3 and 4, the control housing 30 further has a front concealed compartment 36 formed between the base frame 34 and the upper casing 35 at a position in front of the cover opening 31 of the control housing 30, wherein a slanted front wall 37 is defined on the front concealed compartment 36 at a top side of the upper casing 35. The sensor circuit board 511 is concealed in the front concealed compartment 36 and the sensor 512 is supported at the slanted front wall 37 of the control housing 30. Accordingly, a window 351 is formed on the top side of the upper casing 35, wherein the sensor 512 is connected to the sensor circuit board 511 below the window 351 of the upper casing 35. It is worth mentioning that since the sensor 512 is supported at the slanted front wall 37, the sensor 512 is supported in a slanted orientation. Therefore, the sensor 512 is located in front of the cover panel 42 to maximize the detecting range of the sensor 512 at the approaching direction for detecting the target movement.

According to the preferred embodiment, the actuation unit 60 comprises a servo motor 61 supported in the first side concealed compartment 32 of the control housing 30 and a gear transmission unit 62 operatively coupled between the first end portion 411 of the pivot shaft 41 and the servo motor 61 for transmitting a rotational power from the servo motor 61 to the pivot shaft 41.

Accordingly, the sensor 512 will send the sensor signal to the actuation unit 60, the servo motor 61 is activated for generating the rotational power, wherein the rotational power is transmitted through the gear transmission unit 62 to drive the pivot shaft 41 to rotate. It is worth mentioning that the servo motor 61 can generate a forward rotational power to drive the pivot shaft 41 so as to move the cover panel 42 from the closed position to the opened position, and can generate a rearward rotational power to drive the pivot shaft 41 so as to move the cover panel 42 from the opened position to the closed position.

The gear transmission unit 62 is a decelerating gear unit for controllably lifting up and dropping down the cover panel 42 at a speed determined by gear ratios of the gear transmission unit 62 so as to move the cover panel 42 between the opened and closed positions in a hydraulic manner. In other words, the gear transmission unit 62 is adapted to transmit and convert the rotational power to the controlled decelerating and torque enhancing force so as to move the cover panel 42 between the opened and closed positions in a hydraulic manner. In other words, with the help of the gear transmission unit 62, the cover panel 42 can be lifted up and down in a manner as though it is lifted up and down hydraulically, i.e. generation of a decelerating and torque enhancing force in a stable and controllable manner.

Figure 5:
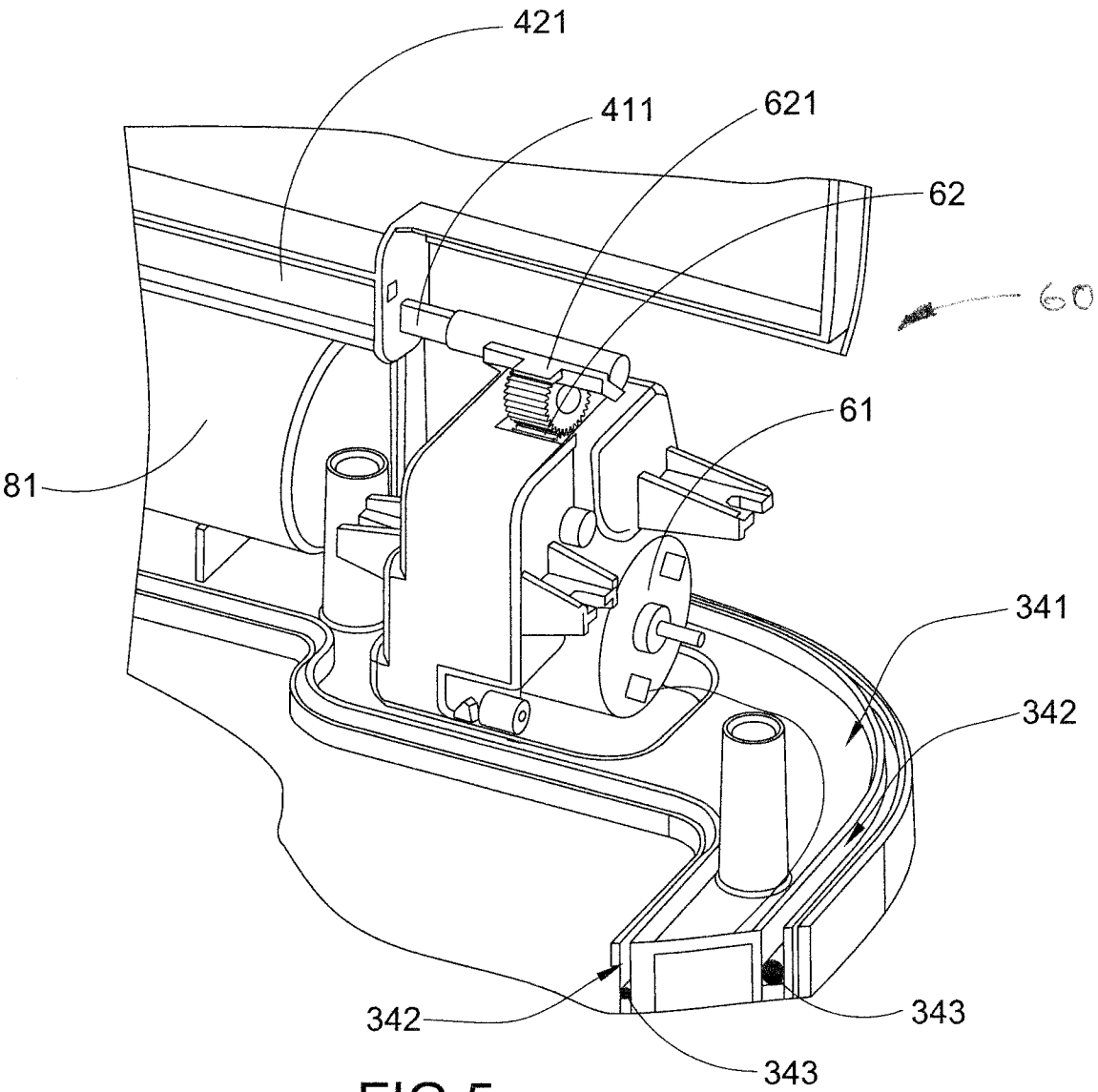
FIG. 5 is a perspective view of the actuation driving arrangement of the waterproof induction container according to the above preferred embodiment of the present invention.

As shown in FIG. 5, the gear transmission unit 62 comprises a gear worm sector 621 affixed at the first end portion 411 of the pivot shaft 41 to operatively coupled with the servo motor 61 via a gear seat. In particular, the gear worm sector 621 is one of the gear elements of the gear transmission unit 62. It is worth mentioning a curvature of the gear worm sector 621 is configured corresponding to the rotational movement of the pivot shaft 41. In other words, the angular length of the gear worm sector 621 is configured to allow the cover panel 42 to move between the opened and closed positions. Therefore, the servo motor 61, the transmission gear unit 62, and the pivot shaft 41 are directly and operatively linked with each other so as to minimize energy lost through the energy transmission.

The automatic driving arrangement further comprises a resilient element 70 concealed in the second side concealed compartment 33 of the control housing 30 and coupled at the second end portion 412 of the pivot shaft 41. In one embodiment, the resilient element 70 is a coil spring coaxially coupled at the second end portion 412 of the pivot shaft 41 to apply an urging force to the cover panel 42. Preferably, one end of the coil spring is biased against the shaft sleeve 421 and an opposed end of the coil spring is biased against the shaft housing 301 to apply the urging force to the cover panel 42. Accordingly, the urging force generated by the resilient element 70 serves as an initial force towards the cover panel 42 for initially pushing up the cover panel 41 simultaneously when the cover panel 42 is started to move from the closed position to the opened position. In other words, the resilient element 70 will help the servo motor 61 to initially lift up the cover panel 42 at the closed position. The the urging force generated by the resilient element 70 also serves as a weight supporting force for partially offsetting a weight of the cover panel 42 when the cover panel 42 is started to move from the opened position to the closed position.

It is worth mentioning that the two end portions 411, 412 of the pivot shaft 41 are extended into the side concealed compartments 32, 33 respectively and are operatively linked to the actuation unit 60 and a resilient element 70, such that the rotational movement of the pivot shaft 41 is balanced at the two ends portions 411, 412 thereof to ensure the smooth pivotal movement of the cover panel 42.

The waterproof induction container further comprises a power supply unit 80 for electrically connecting with the sensor unit 50 and the actuation unit 60 of the automatic driving arrangement, wherein the power supply unit 80 comprises a battery compartment 81 formed within the rear portion of the control housing 30 and a battery compartment cover 82 detachably coupled at a rear wall 301 of the control housing 30 to enclose the battery compartment 81.

According to the preferred embodiment of the present invention, the power supply unit 80 is adapted for receiving one or more batteries (such as disposable batteries or rechargeable batteries) which acts as energy source for operating the automatic driving arrangement. Alternatively, the power supply unit 80 may be electrically connected to an external AC power source or utilizes rechargeable batteries for providing power to the automatic driving arrangement.

Figure 6:
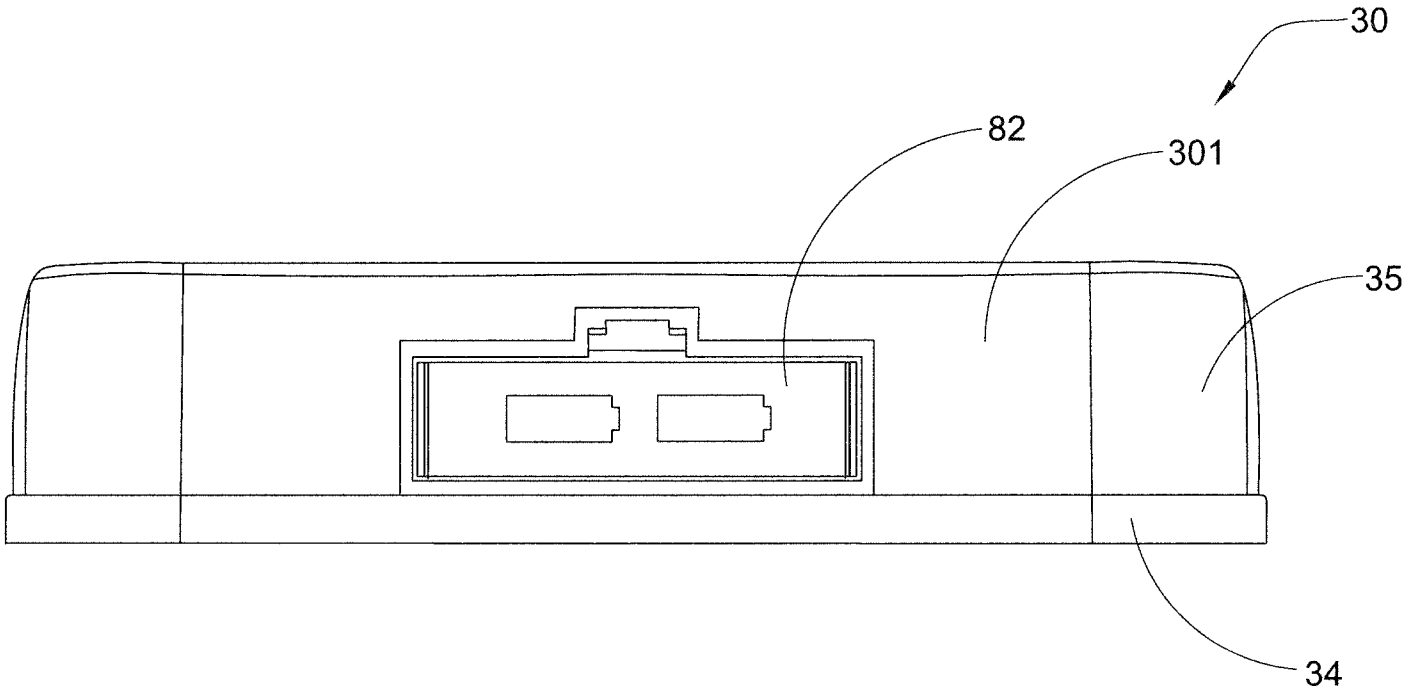
FIG. 6 is a rear view of a power supply unit of the waterproof induction container according to the above preferred embodiment of the present invention.
Figure 7:
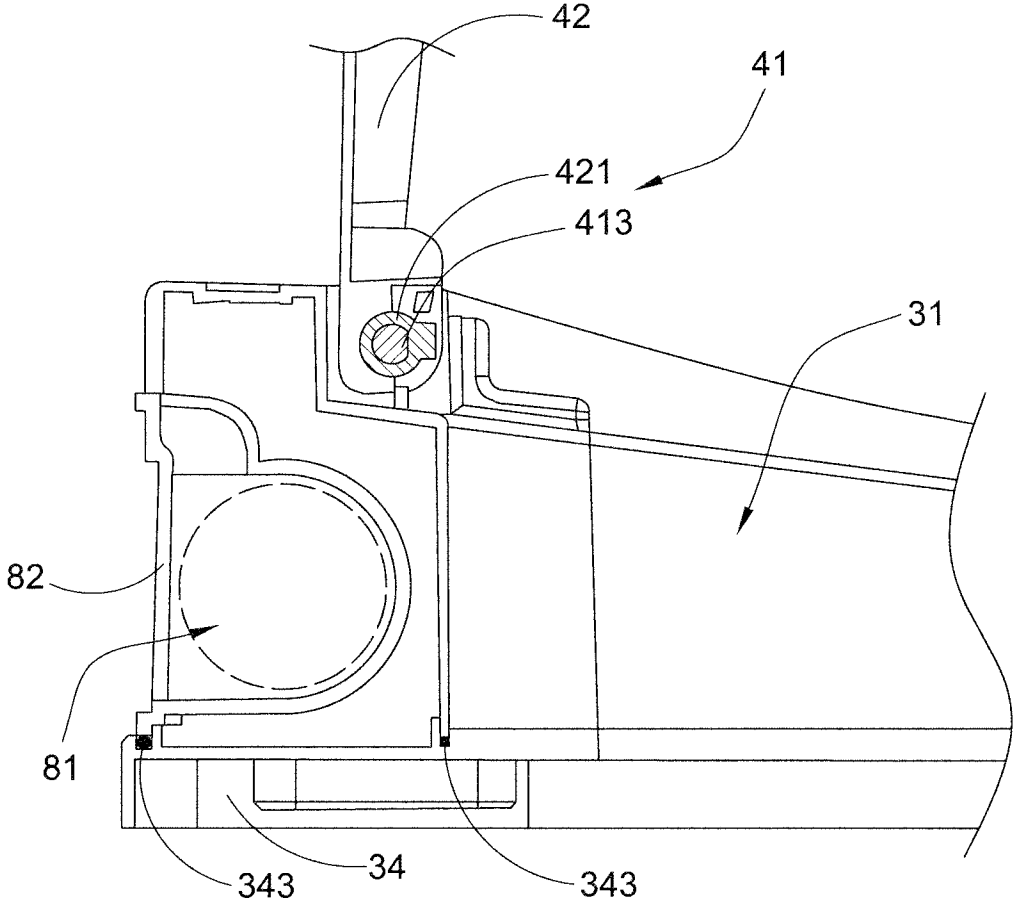
FIG. 7 is a sectional view of the induction actuated container cover according to the above preferred embodiment of the present invention.
Figure 8:
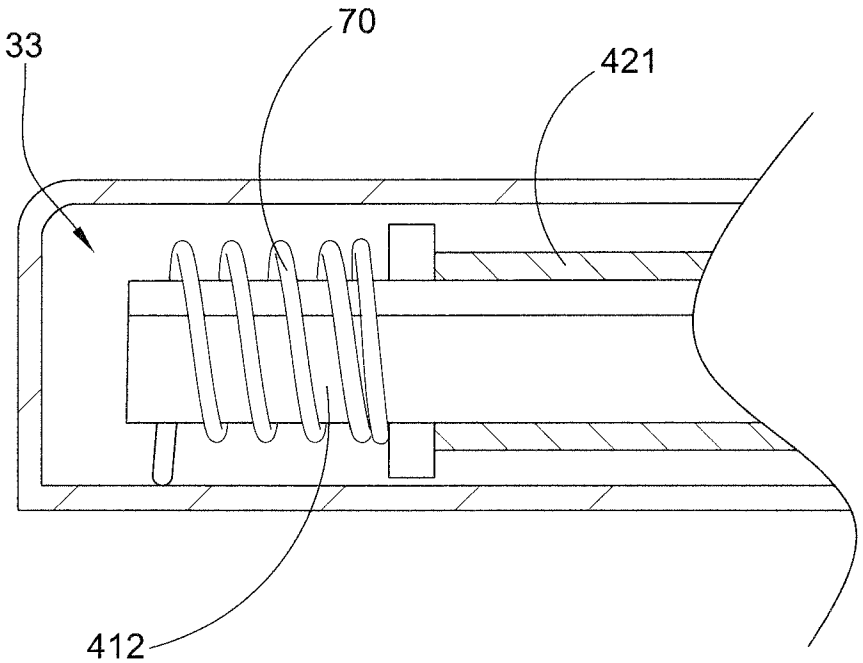
FIG. 8 illustrates the resilient element of the induction actuated container cover according to the above preferred embodiment of the present invention.

As shown in FIGS. 6 and 7, the battery compartment 81 is formed at the control housing 30 at a position that an opening of the battery compartment 81 is formed at the rear wall 301 of the control housing 30, wherein the batteries can be operatively received in the battery compartment 81. The battery compartment 81 is located between the first and second side concealed compartments 32, 33 and below the pivot shaft 41.

The battery compartment cover 82 is a panel detachably coupled at the rear wall 301 of the control housing 30 at the opening of the battery compartment 81 to enclose the battery compartment 81. In other words, the user is able to access the power supply unit 80, such as replacing the battery, without detaching the control housing 30 from the container body 10. In addition, since there is no access of the power supply unit 30 from the storage cavity 11, the battery compartment 81 is not communicated with the storage cavity 11 to prevent any contamination of the batteries and the battery compartment 81 by moisture, corrosive gas, and/or trash residuals from the storage cavity 11.

The operation of the present invention is as follows: when the automatic driving arrangement is turned on, the sensor 512 is activated to search for user's movement in a detection range, e.g. an area in front of the induction actuated container, and when a user actually enters the detection range and approaches the induction actuated container, the sensor 512 will generate an actuation signal to the actuation unit 60 which then activates the servo motor 61 for controllably lifting up the cover panel 42 from the closed position to the opened position, and when the user leaves the detection range, the sensor 512 will also send another actuation signal to the actuation unit 60 which then actuates the servo motor 61 for moving the cover panel 42 from the opened position back to the closed position.

It is worth mentioning that, even if the user does not leave the detection range for long, the sensor circuit board 511 is pre-programmed to activate closing of the cover panel 42 when a predetermined time lapses after the cover panel 42 has been opened. This ensures that the cover panel 42 will be closed after a predetermined time period. Thus, it is important to stress that the sensor circuit board 511 can actually pre-programmed in a wide variety of ways so as to fit specific needs of individual manufacturers or users. Moreover, the cover panel 42 may also be manually operated through a plurality of control buttons provided on the control housing 30.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A waterproof induction container, comprising:

a container body having a storage cavity and a container opening; and an induction actuated container cover which comprises:

a control housing detachably coupled at said container body at said container opening thereof, wherein said control housing has first and second side concealed compartments formed at a rear portion of said control housing, and a cover opening formed between said first and second side concealed compartments to communicate with said storage cavity of said container body;

a cover unit which comprises a pivot shaft having first and second end portions extended into said first and second side concealed compartments respectively, and a cover panel pivotally mounted to said control housing via said pivot shaft to pivotally move between a closed position that said cover panel covers at said cover opening to enclose said storage cavity and an opened position that said cover panel exposes said cover opening for communicating with said storage cavity; and an automatic driving arrangement, which comprises:

a sensor unit mounted at said control housing for detecting a target movement of a user;

an actuation unit concealed in said first side concealed compartment of said control housing in a waterproof manner to operatively link with said sensor unit and to operatively coupled to said pivot shaft, wherein said actuation unit is actuated to move said cover panel via said pivot shaft between said opened and closed positions; and an element arranged to initially push up said cover panel simultaneously when said cover panel is started to move from said closed position and partially offsetting a weight of said cover panel when said cover panel is started to move from said opened position.

2. The waterproof induction container, as recited in claim 1, wherein said actuation unit comprises a servo motor supported in said first side concealed compartment of said control housing and a gear transmission unit operatively coupled between said first end portion of said pivot shaft and said servo motor for transmitting a rotational power from said servo motor to said pivot shaft.

3. The waterproof induction container, as recited in claim 2, wherein said gear transmission unit comprises a gear worm sector affixed at said first end portion of said pivot shaft to operatively coupled with said servo motor.

4. The waterproof induction container, as recited in claim 3, wherein said gear transmission unit is a decelerating gear unit for controllably lifting up and dropping down said cover panel at a speed determined by gear ratios of said gear transmission unit so as to move said cover panel between said opened and closed positions in a hydraulic manner.

5. The waterproof induction container, as recited in claim 3, wherein said control housing comprises a lower base frame detachably coupled at said container opening of said container body, and an upper casing sealed and coupled at said lower base frame to define said first and second side concealed compartments therebetween.

6. The waterproof induction container, as recited in claim 3, wherein said control housing has a trapezoid cross section that a height of said front portion of said control housing is shorter than that of said rear portion thereof to maximize a size of each of said first and second side concealed compartments.

7. The waterproof induction container, as recited in claim 3, further comprising a power supply unit for electrically connecting with said automatic driving arrangement, wherein said power supply unit comprises a battery compartment formed within said rear portion of said control housing and a battery compartment cover detachably coupled at a rear wall of said control housing to enclose said battery compartment.

8. The waterproof induction container, as recited in claim 5, wherein said control housing has a trapezoid cross section that a height of said front portion of said control housing is shorter than that of said rear portion thereof to maximize a size of each of said first and second side concealed compartments.

9. The waterproof induction container, as recited in claim 2, wherein said means comprises a resilient element concealed in said second side concealed compartment of said control housing and coupled at said second end portion of said pivot shaft to apply an urging force as an initial force towards said cover panel for initially pushing up said cover panel simultaneously when said cover panel is started to move from said closed position and as a weight supporting force for partially offsetting a weight of said cover panel when said cover panel is started to move from said opened position.

10. The induction actuated container cover, as recited in claim 2, wherein said control housing has a front concealed compartment defining a slanted front wall, wherein said sensor unit comprises sensor circuit board concealed in said front concealed compartment and a sensor supported at said slanted front wall of said control housing to operatively linked to said sensor circuit board, such that said sensor is located in front of said cover panel to maximize said detecting range of said sensor at said approaching direction for detecting said target movement.

11. The waterproof induction container, as recited in claim 1, wherein said control housing comprises a lower base frame detachably coupled at said container opening of said container body, and an upper casing sealed and coupled at said lower base frame to define said first and second side concealed compartments therebetween.

12. The waterproof induction container, as recited in claim 11, wherein said means comprises a resilient element concealed in said second side concealed compartment of said control housing and coupled at said second end portion of said pivot shaft to apply an urging force as an initial force towards said cover panel for initially pushing up said cover panel simultaneously when said cover panel is started to move from said closed position and as a weight supporting force for partially offsetting a weight of said cover panel when said cover panel is started to move from said opened position.

13. The induction actuated container cover, as recited in claim 11, wherein said control housing has a front concealed compartment defining a slanted front wall, wherein said sensor unit comprises sensor circuit board concealed in said front concealed compartment and a sensor supported at said slanted front wall of said control housing to operatively linked to said sensor circuit board, such that said sensor is located in front of said cover panel to maximize said detecting range of said sensor at said approaching direction for detecting said target movement.

14. The waterproof induction container, as recited in claim 1, wherein said control housing has a trapezoid cross section that a height of said front portion of said control housing is shorter than that of said rear portion thereof to maximize a size of each of said first and second side concealed compartments.

15. The waterproof induction container, as recited in claim 1, wherein said means comprises a resilient element concealed in said second side concealed compartment of said control housing and coupled at said second end portion of said pivot shaft to apply an urging force as an initial force towards said cover panel for initially pushing up said cover panel simultaneously when said cover panel is started to move from said closed position and as a weight supporting force for partially offsetting a weight of said cover panel when said cover panel is started to move from said opened position.

16. The waterproof induction container, as recited in claim 15, further comprising a power supply unit for electrically connecting with said automatic driving arrangement, wherein said power supply unit comprises a battery compartment formed within said rear portion of said control housing and a battery compartment cover detachably coupled at a rear wall of said control housing to enclose said battery compartment.

17. The waterproof induction container, as recited in claim 1, wherein said cover panel comprises a shaft sleeve formed along a folding edge thereof, wherein an exposed portion of said pivot shaft between said two end portions thereof is received in said shaft sleeve to conceal said exposed portion of said pivot shaft so as to prevent said pivot shaft from exposing to said container opening of said container body, wherein when said pivot shaft is driven by said actuation unit to rotate, said shaft sleeve is driven by said pivot shaft to rotate, so that said cover panel is pivotally moved between said opened position and said closed position.

18. The waterproof induction container, as recited in claim 17, wherein said exposed portion of said pivot shaft has a non-circular cross section and said shaft sleeve has a corresponding non-circular cross section to fit said exposed portion of said pivot shaft, such that said cover panel is pivotally moved between said opened and closed positions along with a rotation of said pivot shaft.

19. The waterproof induction container, as recited in claim 1, wherein said cover panel comprises a shaft sleeve formed along a folding edge thereof, wherein an exposed portion of said pivot shaft between said two end portions thereof is received in said shaft sleeve to conceal said exposed portion of said pivot shaft so as to prevent said pivot shaft from exposing to said container opening of said container body, wherein when said pivot shaft is driven by said actuation unit to rotate, said shaft sleeve is driven by said pivot shaft to rotate, so that said cover panel is pivotally moved between said opened position and said closed position.

20. The waterproof induction container, as recited in claim 19, wherein said exposed portion of said pivot shaft has a non-circular cross section and said shaft sleeve has a corresponding non-circular cross section to fit said exposed portion of said pivot shaft, such that said cover panel is pivotally moved between said opened and closed positions along with a rotation of said pivot shaft.

21. The waterproof induction container, as recited in claim 1, wherein said cover panel comprises a shaft sleeve formed along a folding edge thereof, wherein an exposed portion of said pivot shaft between said two end portions thereof is received in said shaft sleeve to conceal said exposed portion of said pivot shaft so as to prevent said pivot shaft from exposing to said container opening of said container body, wherein when said pivot shaft is driven by said actuation unit to rotate, said shaft sleeve is driven by said pivot shaft to rotate, so that said cover panel is pivotally moved between said opened position and said closed position.

22. The waterproof induction container, as recited in claim 21, wherein said exposed portion of said pivot shaft has a non-circular cross section and said shaft sleeve has a corresponding non-circular cross section to fit said exposed portion of said pivot shaft, such that said cover panel is pivotally moved between said opened and closed positions along with a rotation of said pivot shaft.

23. The waterproof induction container, as recited in claim 1, further comprising a power supply unit for electrically connecting with said automatic driving arrangement, wherein said power supply unit comprises a battery compartment formed within said rear portion of said control housing and a battery compartment cover detachably coupled at a rear wall of said control housing to enclose said battery compartment.

24. The induction actuated container cover, as recited in claim 1, wherein said control housing has a front concealed compartment defining a slanted front wall, wherein said sensor unit comprises sensor circuit board concealed in said front concealed compartment and a sensor supported at said slanted front wall of said control housing to operatively linked to said sensor circuit board, such that said sensor is located in front of said cover panel to maximize said detecting range of said sensor at said approaching direction for detecting said target movement.

* * * * *